US009469892B2

(12) United States Patent
Segal

(10) Patent No.: US 9,469,892 B2
(45) Date of Patent: Oct. 18, 2016

(54) HOT THERMO-MECHANICAL PROCESSING OF HEAT-TREATABLE ALUMINUM ALLOYS

(75) Inventor: Vladimir M. Segal, Howell, MI (US)

(73) Assignee: ENGINEERED PERFORMANCE MATERIALS COMPANY, LLC, Whitmore Lake, MI (US)

( * ) Notice: Subject to any disclaimer, the term of this patent is extended or adjusted under 35 U.S.C. 154(b) by 338 days.

(21) Appl. No.: 13/234,257

(22) Filed: Sep. 16, 2011

(65) Prior Publication Data

US 2012/0085470 A1 Apr. 12, 2012

Related U.S. Application Data

(60) Provisional application No. 61/391,738, filed on Oct. 11, 2010.

(51) Int. Cl.

| | |
|---|---|
| ***C22F 1/04*** | (2006.01) |
| ***C22C 21/00*** | (2006.01) |
| ***C22C 21/10*** | (2006.01) |
| ***C22C 21/08*** | (2006.01) |
| ***C22C 21/12*** | (2006.01) |
| ***C22F 1/05*** | (2006.01) |
| ***C22F 1/053*** | (2006.01) |
| ***C22F 1/057*** | (2006.01) |

(52) U.S. Cl.

CPC ..... *C22F 1/04* (2013.01); *C22C 21/08* (2013.01); *C22C 21/10* (2013.01); *C22C 21/12* (2013.01); *C22F 1/05* (2013.01); *C22F 1/053* (2013.01); *C22F 1/057* (2013.01)

(58) Field of Classification Search

CPC ..... C22C 21/08; C22C 21/10; C22C 21/12; C22F 1/057; C22F 1/05; C22F 1/053; C22F 1/04

USPC ..... 148/695, 697, 698, 415, 416, 549–552; 420/528

See application file for complete search history.

(56) References Cited

U.S. PATENT DOCUMENTS 3,706,606 A 12/1972 Di Russo et al.
4,092,181 A * 5/1978 Paton et al. ..... 148/694

(Continued)

FOREIGN PATENT DOCUMENTS

JP 2008196009 * 8/2008 ..... C22F 1/04
WO WO2009/132436 11/2009

OTHER PUBLICATIONS

Int'l App. No. PCT/US2011/055405 Search Report and Written Opinion dated Feb. 23, 2012.

*Primary Examiner* — Scott Kastler
*Assistant Examiner* — Michael Aboagye
(74) *Attorney, Agent, or Firm* — Reising Ethington PC

(57) ABSTRACT

The invention includes the hot thermo-mechanical processing of heat-treatable aluminum alloys comprising preparation of the billet material, heating the billet to obtain the temperature for solution treatment, holding the billet at this temperature a sufficient amount of time required for the dissolution of soluble elements, cooling the billet to the temperature necessary for plastic deformation with essential preservation of the solid solution, plastic deformation, immediate quenching of the billet after plastic deformation, and then billet aging at the corresponding temperature and time. Additional plastic deformation may be used between stages of quenching and aging. An embodiment specifies cooling rate, forging temperature and strain rate.

16 Claims, 5 Drawing Sheets

(56) References Cited

U.S. PATENT DOCUMENTS

| | | | | | |
|---|---|---|---|---|---|
| 4,358,324 | A * | 11/1982 | Mahoney et al. | ..... | 148/690 |
| 4,486,242 | A * | 12/1984 | Ward et al. | ..... | 148/564 |
| 4,596,609 | A | 6/1986 | Rennhack | | |
| 4,645,544 | A * | 2/1987 | Baba et al. | ..... | 148/693 |
| 5,194,102 | A * | 3/1993 | Wyss | ..... | 148/695 |
| 6,350,329 | B1 * | 2/2002 | Troeger et al. | ..... | 148/564 |
| 8,163,113 | B2 | 4/2012 | Mishra | | |
| 2004/0094249 | A1 * | 5/2004 | Uchida et al. | ..... | 148/693 |
| 2007/0084527 | A1 | 4/2007 | Ferrasse | | |
| 2010/0319820 | A1 * | 12/2010 | Koma | ..... | C22C 21/02 148/695 |

* cited by examiner

HOT THERMO-MECHANICAL PROCESSING OF HEAT-TREATABLE ALUMINUM ALLOYS

CROSS-REFERENCE TO RELATED APPLICATIONS

This application is a non-provisional application and claims the benefit of U.S. Provisional Application No. 61/391,738 filed Oct. 11, 2010. The disclosure of which is incorporated herein by reference.

FIELD OF THE INVENTION

The present invention relates to methods of thermo-mechanical processing of heat-treatable aluminum alloys and fabrication of products and components having superior strength, toughness, fatigue, heat resistance and corrosion characteristics.

BACKGROUND OF THE INVENTION

Heat-treatable aluminum alloys belong to a large class of age-hardenable materials comprising base metals (Al, Fe, Ti, Mg, Cu, Ni, Mo, W and other) and alloying elements having a strong dependence upon solubility related to temperature. At high temperatures, these elements can be fully dissolved, then fixed into a solid solution by quenching, and, finally, precipitated into a matrix of the base metal during aging at specific temperature and time. Aging forms very fine precipitates which provide a significant strengthening effect. For heat treatable aluminum alloys, such processing is the typical T6 temper route that is usually used following forming or machining operations. However, because of high temperature solution treatment, materials and components after T6 temper have coarse grain structures. To prevent grain growth during solution treatment and exposures to increased temperatures, most precipitation hardening alloys comprise insoluble elements that form particles and dispersions of second phases. These brittle intermetallic phases, typical of a size more than 5 microns, are stress concentrators and origins of micro-cracks under monotonic and cyclic loading resulting in insufficient ductility, toughness, fatigue and stress corrosion.

It is known in the art that improvement in the properties of precipitation hardening alloys may be attained by thermo-mechanical processing (TMP) using plastic deformation after solution treatment. Depending on the temperature of deformation, there is cold and hot TMP. For cold thermo-mechanical processing (CTMP), deformation is performed prior to aging, during aging and after aging at temperatures below or equal to the aging temperature. Different variants of cold TMP were described in U.S. Pat. Nos. 3,706,606; 4,596,609, U.S. Patent Application No. 20100243113, International Application WO/2009/132436, and others. In comparison with T6 temper, cold TMP hardens the matrix, refines and more uniformly distributes precipitates and increases the material strength. An especially strong hardening effect of cold TMP is observed when intensive deformation is performed by Equal Channel Angular Extrusion as it has been disclosed in U.S. Patent Application No. 20070084527. However, CTMP: (i) develops substructures within grains but does not refine coarse grains induced during solution treatment; (ii) requires high stresses and loads; (iii) may result in cracks because of insufficient material ductility; and (iv) cannot be applied to complicated components and for operations of net shape forming.

Hot thermo-mechanical processing (HTMP) is usually performed by forging, rolling or extrusion at high temperatures followed immediate quenching and aging (FIG. 1). The most known version of HTMP is intermediate thermo-mechanical processing (ITMP) often designated as T5 temper. With proper strain rate and quenching time after deformation, ITMP produces dynamically recrystallized fine grain structures which improve the material toughness and fatigue. It also resolves other issues of CTMP. However, forging temperatures and heating time during ITMP are not sufficient to transfer all soluble elements into the solid solution. Part of the soluble elements form large precipitates which do not contribute to the hardening effect, and the material strength after hot TMP is noticeably lower than that for T6 condition. Therefore, ITMP has found restricted industrial applications and its potential for HTMP remains unrealized. An ordinary practice is to use T6 heat treatment after hot forming and machining operations as shown in FIG. 2, if the primary interest is the material strength.

The present invention combines advantages of cold and hot TMP and eliminates the mentioned shortcomings. From foregoing explanations, it is clear that such processing technique would be very desirable in the art.

SUMMARY OF THE INVENTION

In one embodiment, a method of hot thermo-mechanical processing of heat-treatable aluminum alloys is provided. The method comprises preparation of the material billet with soluble and insoluble elements, heating the billet to solution treatment temperature, holding the billet at this temperature for dissolution of soluble elements, cooling the billet with controllable rate to the plastic deformation temperature, plastic deformation of the billet with prescribed strain and strain rate, immediate quenching of the formed billet, and ageing of the billet at the corresponding temperature and time.

An embodiment of the method is a step of additional cold or warm plastic deformation between the steps of quench and aging.

An embodiment also includes aluminum alloy materials and components with ultra-fine structures of the average grain size from 1 microns to 10 microns, second phases and dispersions of a size less than 5 microns, and nano/submicron sized precipitations providing superior properties when compared to the T6 and T5 or ITMP temper conditions.

In one embodiment, such alloys are heat-treatable aluminum alloys of series 2XXX, 6XXX, 7XXX and 8XXX. In another embodiment, the alloy composition contains Fe, Mn and other elements generating coarse second phases and dispersions in weight concentration less than 0.1%. In another embodiment, the alloy composition contains structure stabilizing elements such as Zr, Cr and Sc of the weight concentration from 0.05% to 0.25%.

In one embodiment, the billet cooling rate from the solution treatment temperature to the deformation temperature is selected in a range from 1° C. to 10° C. per minute, the forging temperature is selected below the incipient melting temperature of the alloy as the highest temperature providing defectless plastic deformation for the related material condition, and strain rate is within a range from 0.1 $sec^{-1}$ to 10 $sec^{-1}$.

In one embodiment, plastic deformation is performed by open forging.

In one embodiment, plastic deformation is performed by die forging. In a particular case, die forging includes billet preheating, preform preparation, forging in blocker dies, forging in finish die, immediate quenching, cold flash trimming, and straightening/coining.

In one embodiment, the plastic deformation is performed by rolling.

In one embodiment, plastic deformation is performed by extrusion.

According to another embodiment, there is provided an aluminum alloy comprising heat-treatable alloys of series 2XXX, 6XXX, 7XXX or 8XXX. The aluminum alloy has fine structures of the average grain size from 1 microns to 10 microns. The alloy further comprises second phases and dispersions of size less than 5 microns. The alloy further comprises nano/submicron sized precipitations.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
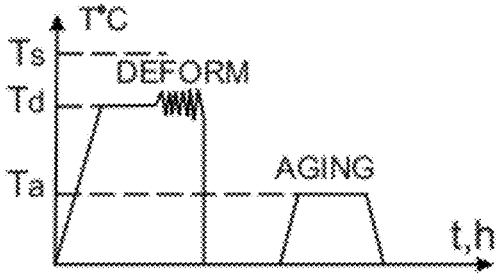
FIG. 1 is a schematic temperature-time diagram for Intermediate thermo-mechanical processing (ITMP)
Figure 2:
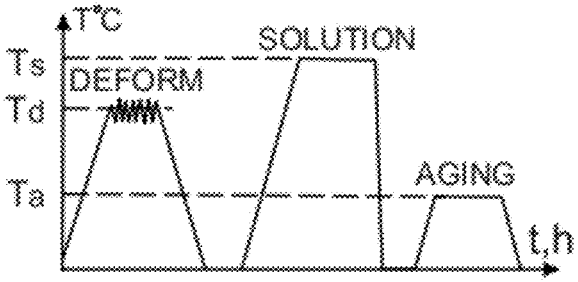
FIG. 2 is a schematic temperature-time diagram for T6 heat treatment after forging.
Figure 3:
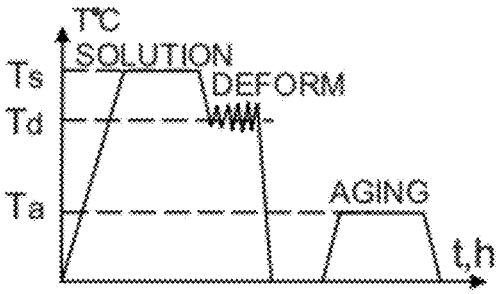
FIG. 3 is a schematic temperature-time diagram for hot thermo-mechanical processing (HTMP) of the invention.

FIG. 3 is a schematic temperature-time diagram of the method of hot thermo-mechanical processing of heat-treatable aluminum alloys in accordance with the invention. The method includes a few successive steps. The first step is preparation of the material billet. The billet comprises Al as the base material and alloying elements forming soluble (precipitates) and insoluble (second phases and dispersions) intermetallic phases. The common alloying elements may include Cu, Mn, Si, Mg, Zn, Fe, Cr, Ni, Ti, Ag, Zr, Li, Pb, Be, B, Sc and other induced in different combinations and proportions. Most aluminum alloys may also contain impurities such as P, S, O in low concentrations (less than 0.05%). The billet may be a cast or preliminary wrought material.

At the next step (FIG. 3), the material billet undergoes solution treatment. The material billet is heated to a solution temperature $T_s$ which is dependent on the alloy. As temperatures $T_s$ are sufficiently high they eliminate most of the effects of prior processing. The billet is held at this temperature for the time necessary to dissolve all soluble elements in the aluminum matrix. This step is quite similar to ordinary solution treatment except that it is included with billet preheating for plastic deformation instead of using separate operations for heat treatment or cold thermo-mechanical treatment.

Figure 4:
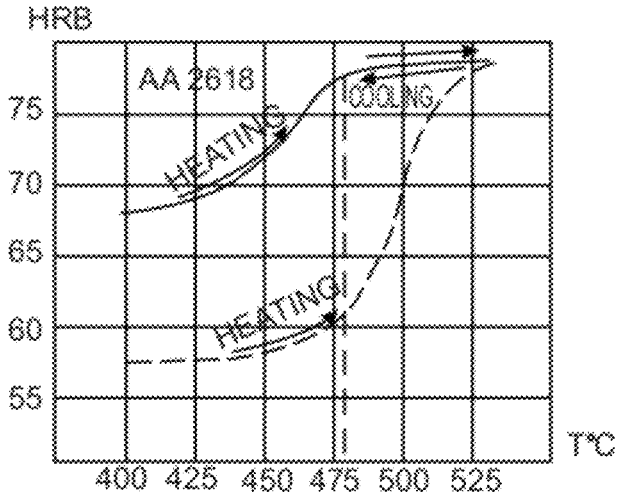
FIG. 4 is a diagram of attainable hardness HRB after HTMP (solid line) and after ITMP (dashed line) in function of deformation temperature for AA 2618.
Figure 5:
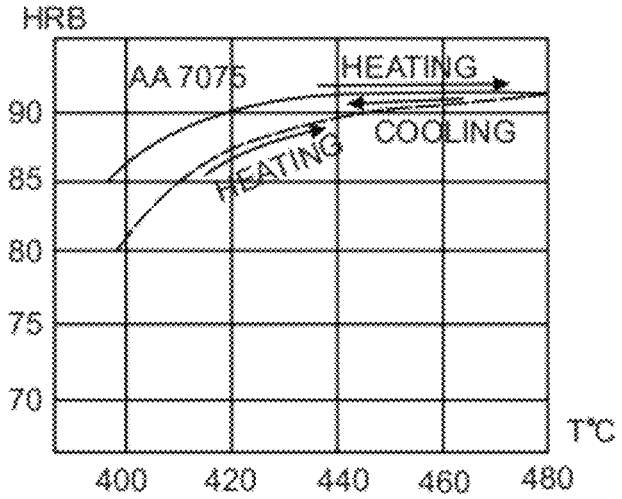
FIG. 5 is a diagram of attainable hardness HRB after HTMP (solid line) and ITMP (dashed line) in function of deformation temperature for AA 7075.

After solution treatment, the billet is cooled to the temperature for hot plastic deformation $T_d$ (FIG. 3). Depending on cooling rate, there appeared a noticeable difference in the kinetics of the material temperature and the dispersion of precipitates. For sufficiently high cooling rates, that will be discussed later, the material temperature can be reduced to the deformation temperature Td without noticeable dispersion of precipitates from the solid solution. The amount of dissolved elements at some moment may be fixed by water quench. During subsequent aging, the dissolved elements precipitate and increase the material hardness. Related diagrams of hardness versus temperature reveal precipitation kinetics as a result of cooling from the solution condition. As an example, FIGS. 4, 5 show such diagrams (solid lines) for aluminum alloys AA 2618 and AA 7075, respectively, during cooling with rate 1.5° C. per minute. For both alloys, the hardness identical to T6 condition may be extended far below the solution temperatures $T_s$ of 529° C. for AA 2618 and 480° C. down to the temperature ranges of hot deformation $T_d$ which are 410-480° C. for AA 2618 and 380-440° C. for AA 7075 That way, hot deformation can be performed continuously with near fully solute precipitates at significantly lower temperatures than the solution treatment temperature. FIGS. 4, 5 also show (dashed lines) attainable hardness after Intermediate TMP at different temperatures. In this case, the alloys were solution treated within temperature ranges of plastic deformation, water quenched and peak aged. Comparison of the corresponding diagrams demonstrates that the present invention provides much higher hardness than ITMP.

The next step in the method is plastic deformation. Plastic deformation changes the billet dimensions and shape in order to fabricate required components and products. At hot processing temperatures, it usually leads to recrystallization of the grain structure. It is known in the art that depending on the material, strain and strain rate, various structures of recrystallization are possible. With the increase of strain and strain rate, the structures are changed from statically recrystallized to dynamically recrystallized and to unrecrystallized deformed structures. For dynamic recrystallization, numerous nuclei of new grains do not grow and form very fine micro structures. However, it is hard to attain during ordinary hot deformation processing such as ITMP because heat treatable aluminum alloys comprise large precipitates and cannot be subjected to intensive strains and high strain rates without fracture. In accordance with the present HTMP, precipitates are dissolved in the aluminum matrix and alloys can be deformed at hot temperatures with high strain and strain rates resulting in dynamic recrystallization and structure refinement. Therefore, the step of plastic deformation is performed within a temperature-strain-strain rate window that provides full or partial dynamic recrystallization for particular alloys.

The following step is the immediate quench of the billet to fix the solid solution and dynamically refined grain structure after plastic deformation. Usually, cold water is the preferable hardening media but hot water and synthetic quenchants can also be used. In one embodiment, the time interval between deformation and quench may be less than 5 seconds for thermo stable aluminum alloys and may be less than 2 second for unstable alloys. This may require a special means for the billet handling from deformation to quench.

The final step is artificial aging at temperature and time which provide the maximum hardness and strength for each alloy. Partial natural aging can be also used in combination with artificial aging. It was found for different aluminum alloys that attainable maximum hardness after HTMP is comparative or slightly higher than hardness for T6 temper and is well superior to hardness after ITMP.

An embodiment of the method is the step of additional plastic deformation between steps of quenching and aging. Additional plastic deformation can be performed at cold or warm temperatures by different forming techniques such as forging, rolling and drawing. Additional deformation induces defects which strengthen the structure and are sites for finest and uniform precipitates during the following step of aging providing further improvement of the material properties.

Figure 6:
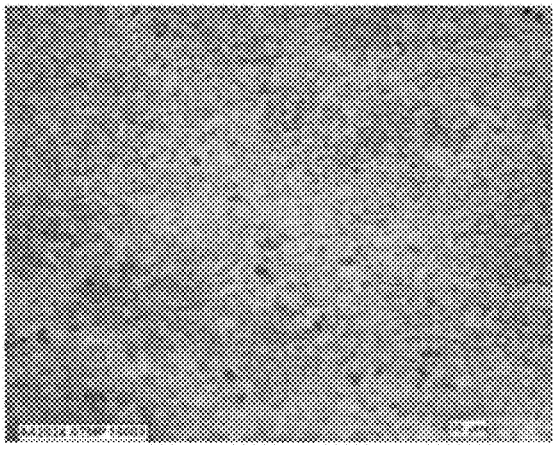
FIG. 6 is microstructure of AA 2024 after HTMP (magnification ×1000)
Figure 7:
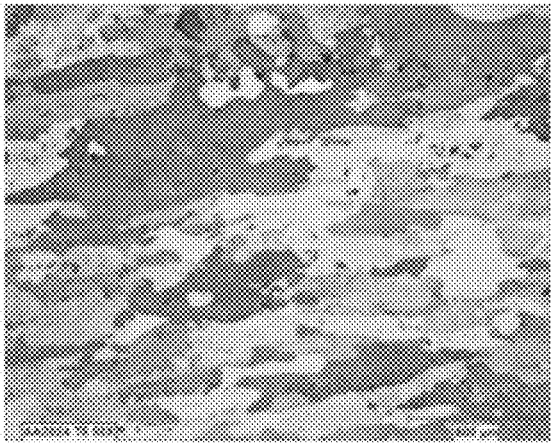
FIG. 7 is microstructure of AA 2024 after T6 temper (magnification ×50)
Figure 8:
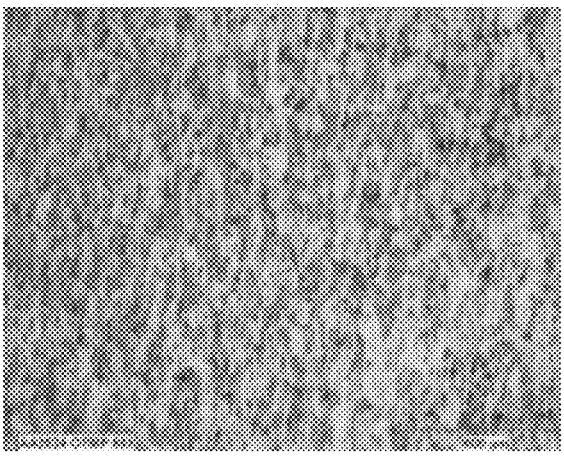
FIG. 8 is microstructure of AA 2024 after ITMP (magnification ×50)

Another embodiment is the aluminum alloy material after hot TMP. Experiments on different precipitate hardening aluminum alloys show specific characteristics of structures after hot TMP. Dynamic recrystallization results in fine, uniform and equiaxial grains. Depending on alloy composition, the average grain sizes ranged from about 1 microns to about 10 microns. Second phases are less than 5 microns. At the same time, the material hardness is similar or higher to the T6 condition of corresponding alloys confirming that precipitates are very fine, of nano and submicron sizes and uniformly distributed. This unusual combination of structural characteristic distinguishes alloys after HTMP of the invention from the same alloys after ordinary ITMP and T6 temper. Examples of structures of AA 2024 are presented in FIG. 6 for HTMP, FIG. 7 for ITMP and FIG. 8 for T6 temper with the average grain size 3 microns, 45 microns and 350 microns, respectively.

HTMP of the invention can be applied to different heat-treatable aluminum alloys of series 2XXX, 6XXX, 7XXX and 8XXX.

Additional embodiment of the invention is aluminum alloys comprising Fe, Mn, Ni and other second phase and dispersion generating elements of weight concentrations less than 0.1% of each. For ordinary heat treatable aluminum alloys, such insoluble particles are usually induced intentionally to prevent grain growth during solution treatment because these grains cannot be refined afterwards. However, coarse phases and dispersions are sites of stress concentrations and origins of micro-cracks which reduce material toughness and resistance to fatigue and stress corrosion. In contrast, for HTMP of the invention, the final grain size is determined by dynamic recrystallization whereas subsequent aging pins grain boundaries by fine precipitates and provides structure stability without second phases. Therefore, this HTMP allows using aluminum alloys with low concentration of insoluble intermetallics that is necessary to reduce or even eliminate second phases and increase alloy ductility, toughness, fatigue and stress corrosion.

Another embodiment of the invention is aluminum alloys comprising stabilizing elements such as Zr, Cr and Sc of the weight concentrations in a range from 0.05% to 0.25%. These elements form thermo-stable precipitations which additionally pin grain boundaries and provide a heat resistance together with high toughness and fatigue to aluminum alloys.

Figure 9:
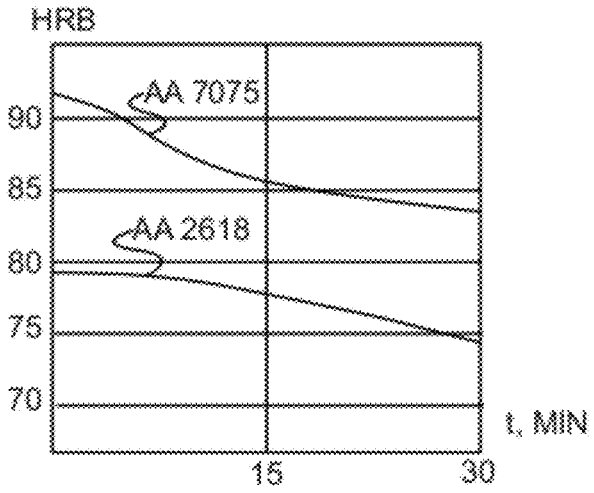
FIG. 9 is a diagram of attainable hardness HRB after HTMP depending on soaking time in the furnace for AA 7075 at temperature 420° C. and AA 2618 at temperature 440° C.

An embodiment also specifies the characteristics of hot thermo-mechanical processing. During cooling from the solution temperature $T_s$ to deformation temperature $T_d$ the solid solution becomes oversaturated and may precipitate. To prevent its decomposition, the cooling rate should be sufficiently large. It has been found for different alloys that the bottom line of the cooling rate to forging temperatures is about 1° C. per minute. This rate preserves the solid solution and provides necessary operational time from 5 to 10 minutes for holding the material in a furnace at the forging temperature. This result can be seen in FIG. 9 for aluminum alloys AA 7075 and AA 2618. Alloys were solution treated at temperatures of 480° C., 1 h and 530° C., 1 h and cooled to forging temperatures of 420° C. and 480° C., respectively, with cooling rate of about 1.5° C. per minute, held at this temperatures during different time, water quench and peak aged. Comparison of hardness data with FIGS. 4, 5 shows that solid solutions remain stable during cooling and additional holding at forging temperatures up to 5-10 minutes. On the other hand, the maximum cooling rate may be restricted by the material thermal conductivity and temperature gradient through the billet. For billets of diameters less than 100 mm, the top limit of cooling rate in electrical furnaces with air flow and programmable controllers was evaluated at about 10° C. per minute.

Another characteristic of hot thermo-mechanical processing of the invention is a selection of the deformation temperature. During ordinary hot deformation of heat-treatable aluminum alloys, large "overaged" precipitates may promote strain localization, adiabatic heating and cracking. In this case, the forging temperature should be significantly lower than the incipient melting temperature of the alloy. With the increase of strain rate, the difference between forging and incipient melting temperatures becomes bigger. In contrast, current embodiments retain the solid solution at temperatures below the incipient melting temperature. Such materials are more ductile and less sensitive to flow localization. Therefore, temperature and strain rate during HTMP may be noticeable higher than for ordinary hot deformation processing resulting in higher properties, better formability and lower loads. For each alloy and strain rate, the temperature of HTMP is selected as the highest temperature providing the defectless material, and is determined on a case by case basis.

An embodiment also defines restrictions on strain rate during HTMP. For strain rates less than 0.1 $sec^{-1}$, dynamic aging or static recrystallization for some alloys may lead to coarsening of precipitates and grain structure with degradation of properties. On the other hand, for strain rates more than 10 $sec^{-1}$, dynamic recrystallization may not be completed and the structure may comprise large deformed original grains instead of fine recrystallized grains. Therefore, the strain rate should be selected in the range from 0.1 $sec^{-1}$ to 10 $sec^{-1}$.

Figure 10:
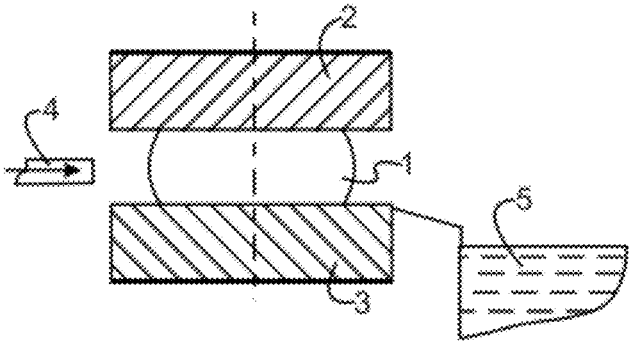
FIG. 10 is a schematic diagram of HTMP during forging.

Some embodiments relate to plastic deformation techniques. In one embodiment, deformation is performed by open forging (FIG. 10). A billet 1 is solutionized, and cooled to the forging temperature in an oven. Then, it is moved to a press and forged between anvils 1 and 3. Immediately after forging, a manipulator 4 pushes the billet into a quenching bath 5.

Figure 11:
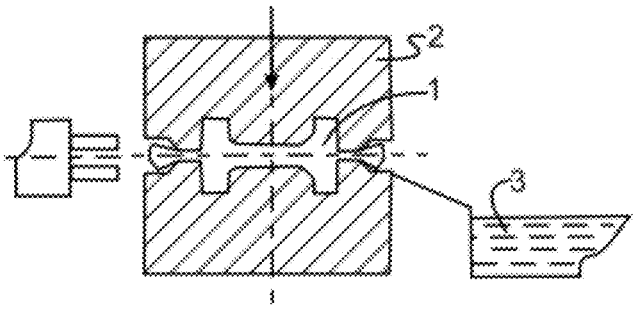
FIG. 11 is a schematic diagram of HTMP during die forging.

In another embodiment of the invention, deformation is performed by forging in dies (FIG. 11). The preliminary heated, solutionized and cooled billet 1 may be further subjected to operations of roll forming and forging in blocker dies. In some cases, owing to better formability, blocker dies can be eliminated. After forging in a finish dies 2, the billet is immediately delivered to the quenching bath 3. Subsequent operations of flash trimming, straightening and coining are performed at room or warm temperatures. Additionally, the forging pre-form may be prepared prior to billet heating.

Figure 12:
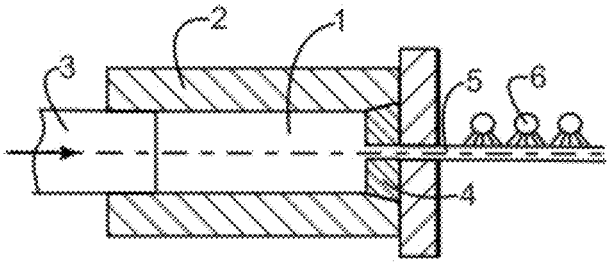
FIG. 12 is a schematic diagram of HTMP during extrusion.

Another embodiment of the invention is hot thermo-mechanical extrusion (FIG. 12). After solution treatment and cooling to the forging temperature, the billet 1 is inserted into a container 1 and extruded by a punch 3 through a die 4 into a product 5 which is immediately quenched by sprayers 6. Such processing may be performed at higher temperatures and speeds than ordinary hot extrusion and provides ultra-fine grained extrusions having improved properties. Additional benefits are larger productivity, longer tool life and fabrication of more intricate shapes using smaller presses. FIG. 12 shows direct extrusion, however, it can be extended to other extrusion techniques such as extrusion of pipes, backward extrusion, etc. known in the art.

Figure 13:
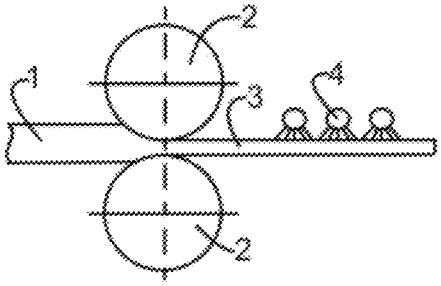
FIG. 13 is a schematic diagram of HTMP during rolling.

Similar embodiment is hot thermo-mechanical rolling (FIG. 13) where the billet 1 preheated in accordance with the invention is rolled between rolls 2 and quenched by sprayers 3.

EXAMPLE I

Samples of aluminum alloy AA 2618 were processed for three different conditions. In a case of HTMP, samples were solution treated at a temperature 530° C. for 1 h, cooled to the temperature of 480° C. over a period of 40 minutes, then forged at mechanical press with the strain rate about 2 $sec^{-1}$ and reduction 70%, water quenched in less than 2.5 seconds, and aged at temperature of 199° C. for 8 h. For comparison, the material was also processed via ITMP and T6 temper. For ITMP, samples were heated to the same forging temperature of 480° C. for 1 h, forged with the same strain rate 2 sec−1 and reduction 70%, immediately water quenched and aged at temperature of 199° C., 8 h. For T6 temper, samples were solution treated at temperature of 530 C. for 1 h, water quenched and aged at temperature of 199° C., 10 h. Results of structure characterization and mechanical testing are shown in Table 1.

TABLE I

| Condition | Yield Stress, MPa | Ultimate Tensile Stress, MPa | Elon-gation, % | Average Grain Size, microns |
|---|---|---|---|---|
| T6 | 372 | 441 | 10 | 40 |
| ITMP | 292 | 374 | 21 | 5 |
| HTMP | 378 | 455 | 14 | 3 |

EXAMPLE II

For HTMP, samples of aluminum alloys AA 2024 were solution treated at a temperature 495° C. for 1 h, cooled to the forging temperature of 460° C. over a period of 30 minutes, then forged with strain rate 2 $sec^{-1}$ and reduction 70%, immediately water quenched and aged at a temperature of 190° C. for 10 h. The material was also processed via ITMP and T6 temper. For ITMP, samples were heated to temperature of 460° C. for 1 h, forged with the same strain rate and reduction, water quenched and aged at a temperature of 190° C. for 10 h. For T6 temper, samples were solution treated at a temperature of 495° C., 1 h, water quenched and aged at a temperature of 190° C. for 10 h. Comparison of mechanical properties and grain sizes for three conditions is presented in Table II.

TABLE II

| Condition | Yield Stress, MPa | Ultimate Tensile Stress, MPa | Elon-gation, % | Average Grain Size, microns |
|---|---|---|---|---|
| T6 | 414 | 483 | 13 | 350 |
| ITMP | 295 | 378 | 16 | 45 |
| HTMP | 409 | 458 | 14 | 3 |

EXAMPLE III

Aluminum alloy AA 2026 was processed via HTMP and ITMP. In the first case, the samples were solutionized at a temperature of 495° C. for 1 h, cooled to the forging temperature of 460° C. over a period of 15 minutes, forged at the mechanical press with strain rate 2 $sec^{-1}$ and reduction 70%, water quenched and aged at a temperature of 180° C. for 10 h. In the second case, samples were heated to a forging temperature of 460° C. for 1 h and then forged, quenched and aged similarly to HTMP samples. Testing results for both conditions are show in Table III.

TABLE III

| Condition | Yield Stress, MPa | Ultimate Tensile Stress, MPA | Elon-gation, % | Average Grain Size, microns |
|---|---|---|---|---|
| ITMP | 289 | 371 | 19 | 6 |
| HTMP | 399 | 434 | 18 | 2 |

EXAMPLE IV

Aluminum alloy AA 7075 was processed via present HTMP and T6 temper. For HTMP condition, the samples were solutionized at a temperature of 480° C. for 1 h, forged at the mechanical press with strain rate 2 $sec^{-1}$ and reduction 70%, water quenched and aged at a temperature of 120° C. for 20 h. For T6 condition, samples were solutionized, quenched and aged similarly to HTMP samples. Testing data are presented in Table IV.

TABLE IV

| Condition | Yield Stress, MPa | Ultimate Tensile Stress, MPa | Elon-gation, % | Average Grain Size, microns |
|---|---|---|---|---|
| T6 | 503 | 572 | 11 | 60 |
| HTMP | 518 | 584 | 15 | 5 |

Data of Tables I-IV demonstrate that hot thermo-mechanical processing (HTMP) in accordance with the invention provides significant improvements in comparison with known techniques. Against T6 temper, present HTMP gives identical or better strength and ductility and significant structure refinement. Against ordinary ITMP, present HTMP results in much higher strength, identical ductility and finer structure. Therefore, present HTMP combines advantages and eliminate shortcomings of ITMP and T6 techniques. It is known in the art, that even bigger benefits of present HTMP should be observed for characteristics of toughness, fatigue and corrosion resistance because of much finer structures.

It is understandable for everybody skilled in the art that the invention may be applied to other precipitation hardening alloys and extended to different processing techniques.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of hot thermo-mechanical processing of heat-treatable aluminum alloys, the method comprising:

heating a billet of a heat-treatable aluminum alloy composition to a solution treatment temperature of the aluminum alloy composition and holding the billet at the solution treatment temperature for a time period sufficient to dissolve soluble elements contained in the aluminum alloy composition into a solid solution of an aluminum base;

cooling the billet from the solution treatment temperature of the aluminum alloy composition to a plastic deformation temperature of the aluminum alloy composition at a cooling rate ranging from 1° C. per minute to 10° C. per minute to preserve the solid solution of the of the aluminum base;

plastic deforming the billet at the plastic deformation temperature of the aluminum alloy composition to attain full or partial dynamic recrystallization;

quenching the billet after plastic deforming to fix the solid solution of the aluminum base, the billet having a hardness after quenching; and aging the billet after quenching at a temperature below the plastic deformation temperature to precipitate dissolved soluble elements from the aluminum base and to increase the hardness of the billet.

2. The method of hot thermo-mechanical processing of heat-treatable aluminum alloys of claim 1 in which plastic deforming the billet is performed at a strain rate ranging from 0.1/sec to 10/sec.

3. The method of hot thermo-mechanical processing of heat-treatable aluminum alloys of claim 1 further comprising cold or warm plastic deforming of the billet between the steps of quenching and aging.

4. A method of hot thermo-mechanical processing of heat-treatable aluminum alloys, the method comprising:

preparing a material billet comprising a base aluminum with soluble alloying elements that dissolve into a solid solution of the base aluminum at a solution temperature, the material billet further comprising insoluble dispersions and second phases;

determining a temperature range within which the solid solution of the base aluminum including dissolved alloying elements is essentially preserved during cooling of the material billet from the solution temperature at a cooling rate of 1° C. per minute to 10° C. per minute;

selecting a plastic deformation temperature within the temperature range that provides for defectless deformation at a strain rate of 0.1/sec to 10/sec;

heating the billet to the solution temperature;

holding the billet at the solution temperature for a time necessary for dissolution of the soluble alloying elements into the solid solution of the base aluminum;

cooling the billet to the plastic deformation temperature at a cooling rate of 1° C. per minute to 10° C. per minute;

plastic deforming the billet at a strain rate of 0.1/sec to 10/sec while at the plastic deformation temperature to change the shape of the billet and to provide full or partial dynamic recrystallization;

quenching the billet immediately after plastic deforming of the billet to prevent dispersion of the solid solution of the base aluminum; and aging the billet to form precipitates that result in an increase of a hardness of the billet.

5. The method of hot thermo-mechanical processing of heat-treatable aluminum alloys of claim 4 further comprising cold or warm plastic deforming of the billet between the steps of quenching and aging.

6. An aluminum alloy prepared according to the method of claim 4 having fine structures of an average grain size from 1 micron to 10 microns, second phases and dispersions of a size less than 5 microns, and nano/submicron sized precipitations providing superior properties than related T6 and T5 temper conditions.

7. An aluminum alloy prepared according to the method of claim 4 wherein the billet comprises a 2XXX, 6XXX, 7XXX or 8XXX series heat-treatable aluminum alloy.

8. An aluminum alloy prepared according to the method of claim 4 in which Fe, Mn and other elements generating coarse second phases and dispersions have weight concentrations of less than 0.1% each.

9. An aluminum alloy prepared according to the method of claim 4 comprising at least one of Zr, Cr, or Sc at a weight concentration from 0.05 to 0.25%.

10. The method of hot thermo-mechanical processing of heat-treatable aluminum alloys of claim 4 in which the plastic deformation temperature is below an incipient melting temperature of the material billet.

11. The method of hot thermo-mechanical processing of heat-treatable aluminum alloys of claim 4 in which plastic deforming of the material billet is performed by open forging.

12. The method of hot thermo-mechanical processing of heat-treatable aluminum alloys of claim 4 in which plastic deforming is performed by die forging.

13. The method of hot thermo-mechanical processing of heat-treatable aluminum alloys according to claim 12 comprising preheating of the material billet, preparing a preform, forging in blocker dies, forging in a finish die, immediate quenching, cold/warm flash trimming, and straightening and coining.

14. The method of hot thermo-mechanical processing of heat-treatable aluminum alloys of claim 4 in which plastic deforming is performed by rolling.

15. The method of hot thermo-mechanical processing of heat-treatable aluminum alloys of claim 4 in which plastic deforming is performed by extrusion.

16. A method of hot thermo-mechanical processing of heat-treatable aluminum alloys, the method comprising:

providing a billet of a heat-treatable aluminum alloy composition, the heat-treatable aluminum alloy composition comprising an aluminum base, soluble alloying elements that are soluble in a solid solution of the aluminum base at a solution treatment temperature of the aluminum alloy composition, and insoluble alloying elements that are not soluble in the solid solution of the aluminum base;

heating the billet to the solution treatment temperature of the aluminum alloy composition;

holding the billet at the solution treatment temperature of the aluminum alloy composition to dissolve the soluble elements into the solid solution of the of the aluminum base;

cooling the billet from the solution treatment temperature of the aluminum alloy composition at a cooling rate ranging from 1° C. per minute to 10° C. per minute to a plastic deformation temperature of the aluminum alloy composition so as to preserve the solid solution of the of the aluminum base;

plastic deforming the billet at the plastic deformation temperature of the aluminum alloy composition at a strain rate ranging from 0.1/sec to 10/sec to attain full or partial dynamic recrystallization;

quenching the billet after plastic deforming to fix the solid solution of the aluminum base, the billet having a hardness after quenching; and aging the billet after quenching to precipitate dissolved soluble elements from the aluminum base and to increase the hardness of the billet.

* * * * *